United States Patent [19]

Ward

[11] 4,211,271

[45] Jul. 8, 1980

[54] CONTINUOUS CASTING MOLD GEOMETRY IMPROVEMENT

[75] Inventor: George C. Ward, Carrollton, Ga.

[73] Assignee: Southwire Company, Carrollton, Ga.

[21] Appl. No.: 860,648

[22] Filed: Dec. 14, 1977

[51] Int. Cl.[3] ..... B22D 11/06

[52] U.S. Cl. ..... 164/87; 164/433

[58] Field of Search ..... 164/87, 427, 433, 434, 164/122, 123

[56] References Cited

U.S. PATENT DOCUMENTS

| | | | |
|---|---|---|---|
| 1,841,297 | 1/1932 | Perry et al. | 164/87 |
| 2,749,584 | 6/1956 | Fey et al. | 164/433 |
| 3,331,123 | 7/1967 | Cofer | 164/87 |
| 3,520,352 | 7/1970 | Hess | 164/123 |
| 3,605,868 | 9/1971 | Giadorou | 164/87 |
| 3,703,204 | 11/1972 | Brownstein | 164/87 |
| 3,736,977 | 6/1973 | Stockinger | 164/82 |
| 4,069,860 | 1/1978 | Ward | 164/87 |

FOREIGN PATENT DOCUMENTS

| | | | |
|---|---|---|---|
| 51-62141 | 5/1976 | Japan | 164/433 |

*Primary Examiner*—Robert D. Baldwin
*Assistant Examiner*—K. Y. Lin
*Attorney, Agent, or Firm*—Herbert M. Hanegan; Stanley L. Tate; Robert S. Linne

[57] ABSTRACT

An improvement in wheel-band type continuous metal casting machines wherein a corner filling device or material is used in combination with the mold members such as the wheel and band to modify the mold geometry so as to prevent corner cracking due to the solidification stresses present in conventional mold shapes having sharp or square edges, especially useful in modifying the usual trapezoidal cross sections of prior art molds. Ablative, conductive, or insulating materials, selected in accordance with the desired change in solidification pattern, may be introduced into the mold either separate from, or attached to the moving mold members such as the endless band or the casting wheel.

12 Claims, 8 Drawing Figures

BEFORE POURING

AT POUR POINT

AT SOLIDIFICATION

CONTINUOUS CASTING MOLD GEOMETRY IMPROVEMENT

BACKGROUND OF THE INVENTION

This invention relates to the continuous molten metal casting arts, and more particularly to wheel-band casting machines wherein the mold geometry is substantially square, triangular, rectangular, or trapezoidal. Certain embodiments of this invention may also be used with conventional twin belt or/and plate molds or other vertical casting machines which normally a mold cavity containing corners and thus form a cast bar having sharp edges.

It is well known in the prior art that combinations of the following factors are closely interrelated to the presence or absence of bar cracks, especially corner cracks, in cast steel bar produced by typical metal casting machines: the composition of the metal or alloy being cast, especially alloys in which precipitation of some constituents is a problem; mold geometry and dimensions; speed of casting; overall cooling rate and uniformity of bar cooling. Of these factors, only the metal composition being cast is fixed by preference; except that the mold geometry cannot usually be changed during operation and then only with extreme difficulty. Many other parameters are variable. With conventional wheel-band casting machines the trapezoidal shaped mold cross section with radiused bottom corners has long been recognized as the optimum shape for wheel life, transverse solidification pattern, and bar extraction from the mold (see for example U.S. Pat. No. 3,818,972 and 3,834,444 by Milton Berry and assigned to the assignee of the present invention). However, trapezoidal or square mold cross sections undergoing even slight bending while hot may tend to produce longitudinal or transverse bar cracks with certain metal alloys such as steel, even when cooling rates, or other combinations of parameters are varied over their permissable ranges.

These cracks are attributed to the difficulty of obtaining certain combinations of the above variable casting characteristics, especially heat transfer, casting rate, alloy constituents with a fixed mold geometry. It is known from prior art that some factors are more important than others. For example, when certain constituent elements are precipitated to the grain boundaries they then solidify at a cooler temperature than the predominant constituents. Due to the heat transfer characteristics of conventional square or trapezoidal molds, the intermetallic boundary forms along a longitudinal line extending from the corners, especially the sharp corners of the trapezoidal mold, thereby increasing the risk of bar cracking at this point. Various references in the prior art suggest changing the alloy composition to change the precipitation patterns or changing other factors such as cooling or casting rates to avoid such cracking. This invention is directed at alternate means to reduce or eliminate cracking, thus avoiding the complexities of chemical adjustment and eliminating the uncertainty of changing cooling characteristics for each of several alloys. It also permits continuous casting of otherwise difficult alloy combinations.

Further, in some prior art processes, mechanical corner preparation, such as scalping, is required to facilitate optimum rolling of the cast bar stock into rod even if all parameters have been adjusted to minimize corner cracking due to other corner defects such as excessive porosity or excess flash or fins (i.e., material which has leaked between the wheel and band and solidified to form a thin metal fin) as illustrated in U.S. Pat. Nos. 3,780,552 and 3,469,620.

U.S. Pat. No. 3,736,977 dicloses the use of combustible and non-combustible tapes or the like introduced into the mold corners of plate molds used for vertical casting. However, in the use disclosed in this patent, the tapes are used solely to prevent leakage of molten metal through the gaps formed at the butt joints of the plate mold due to differential thermal expansion of the plates. Molten metal spills and breakthroughs can occur in such a casting method if no such precautions are taken. The instant invention, however, is directed to an entirely different use for the introduction of supplemental material in the mold cavity.

SUMMARY OF THE INVENTION

In this invention, it has been found that reducing the heat transfer rate in the wheel-band corners greatly reduces the tendency of both transverse and longitudinal bar cracks. The combination of said heat transfer reduction and other factors such as radiused mold corners, cast bar chemistry changes due to the mold seal composition, etc., improves elimination of such cracks.

Briefly described, the embodiments of the present invention comprise the introduction of an ablative, conductive, or insulating material or device into the generally trapezoidal mold cavity at the junction of the wheel and band in a continuous steel casting machine of the wheel-band type wherein longitudinal or transverse corner cracking due to the sharp corners and/or solidification pattern due to heat extraction is upset sufficiently to permit more desirable transverse solidification, thereby reducing or eliminating said corner cracking.

In the operation of the present invention the sealing material may be of various substances or materials. It may be metallic or non-metallic, provided that it will not completely melt or vaporize or the like during the period of time it is in contact with the molten or partially solidified metal, and provided that it decreases the heat transfer rates in the corner region of the mold. Low temperature metals such as aluminum or aluminum alloys, tin alloys, copper or even steel may be used in certain applications. A plastic or resinous material may have an application, however advantageously substances such as paper, paper mache, asbestos, plastic, phenolic resins, epoxy resins, silica fibers, glass fibers and mixtures thereof can be used. The preferred sealing material will vary when casting different molten metals, however for the material to be satisfactory it must at least remain partially solid during the length of time it is in contact with the molten or partially solidified metal in the mold so that the molten metal does not solidify in the shape of the original mold, that is with a sharp or square corner. A sealing material such as paper, glass fibers, asbestos, or low temperature metal or the like may be applied to the flexible belt of the casting machine as a continuous strip from a dispenser or alternately may be applied to the edge of the casting wheel. In any event, the material must be applied so that it remains in the corner region of the casting mold.

When casting some molten metals or molten metal alloys it may be advantageous to apply to the sealing material an additional material selected from the group consisting of zirconium or titanium oxide, graphite, charable petroleum products, aluminum powder, iron powder or mixtures thereof.

The cooling rate of the metal can be influenced or controlled by modifying the physical or chemical characteristics of the sealing material. Where the sealing material is abestos or the like it may be additionally treated with a wash such as a metal or chemical wash, thereby providing a more suitable mold film, a molten metal skin or coating or formation thereof.

More specifically, a supplemental material is purposely introduced into the casting machine at the top of the mold to sufficiently modify the cross section of the mold cavities such that a corner chamfer or radius or its equivalent is formed and/or the heat extraction rate is modified to alter the transverse solidification pattern. In an alternate embodiment of this invention, short segmental blocks attached to the casting band, having a tapered portion rising from the band to the mold juncture, may be used to provide a longitudinal chamfer to the otherwise sharply angled corner of the cast bar. Similarly, such short segmental blocks may be hingedly attached to the casting wheel or may be introduced in some other manner.

Thus it is an object of this invention to provide a method by which transverse and longitudinal bar corner cracking, often occurring in continuous cast steel bars due to an improper solidification pattern, may be reduced or eliminated.

Another object of this invention is the retardation of heat transfer from the solidifying cast bar to the mold only at sharp corners.

Another object of the invention is to allow the production of a wider range of compositions of metal bars with only a small variation in operating factors by providing means to vary the mold shape.

Still another object of this invention is the provision of a method and apparatus to reduce longitudinal and transverse bar corner cracking which may be used with prior art wheel-band, twin belt, plate mold, or other casting machines.

Other objects, features, and advantages of the present invention will become apparent to those skilled in the art upon reading the following specification when read in conjunction with the accompanying drawings and appended claims.

DESCRIPTION OF THE PREFERRED EMBODIMENT

Figure 1:
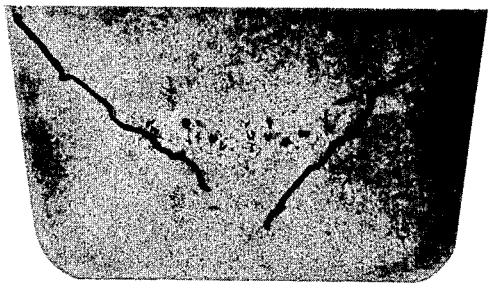
FIG. 1 is a photograph of a cross section of a typical trapezoidal shaped bar continuously cast on a wheel-belt casting machine, illustrating the problem of longitudinal corner-cracking of a prior art bar.

The problem addressed by this invention is shown most clearly in FIG. 1, where severe longitudinal corner cracks are evident in a prior art cast bar 10. Such a bar 10 would ordinarily not be salvageable even by deep scarfing of the corners.

Figure 2:
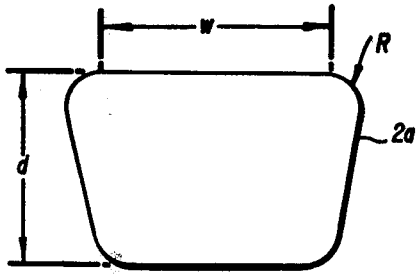
FIG. 2 is a diagramatic sketch of a bar produced by the present invention.
Figure 4A:
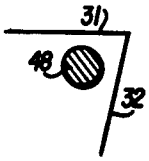
FIG. 4*a*, 4*b* and 4*c* illustrates a sequence of events utilizing the preferred embodiment of the present invention.
Figure 4B:
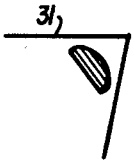
Figure 4C:
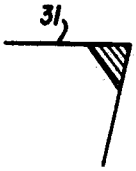
Figure 3A:
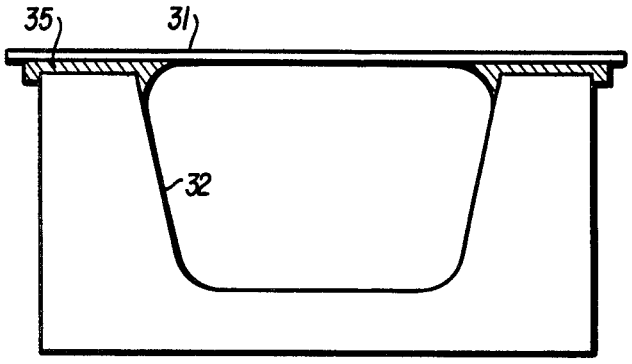
FIGS. 3*a*, 3*b* and 3*c* , illustrates molds embodying features of the present invention.
Figure 3B:
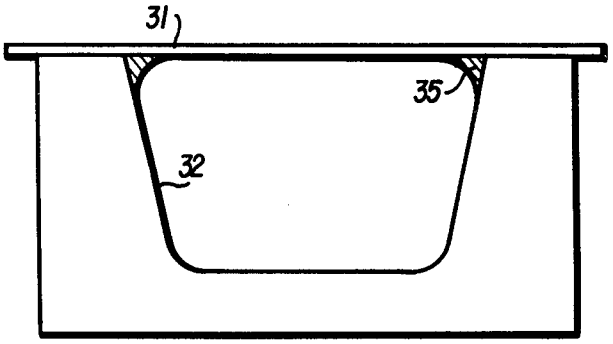
Figure 3C:
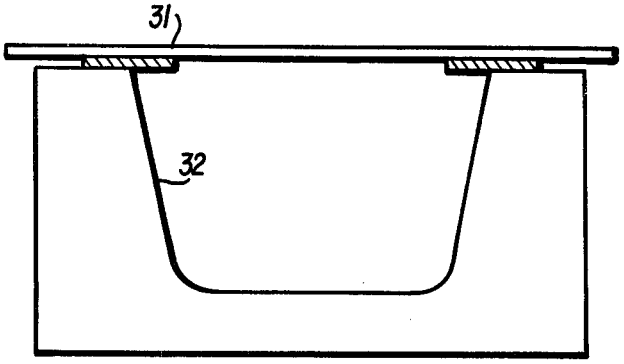

FIG. 2 illustrates the shape of a cast bar produced by the present invention. The bar 20 has a width W, a depth D and corners which are of rounded shape and have a radius of curvature R. Bar 20 is produced in a wheel-band type continuous casting mold which includes means for shaping the sharp corners of a cast bar. The means for shaping the corners of the cast bar can be similar to the means illustrated in FIGS. 3*a*, 3*b* and 3*c*. FIG. 3*a* illustrates a shaped sealing means 35 introduced between the casting wheel 32 and the band 31. The sealing material may be insulating or conducting, ablative or inert. In any case, it will affect the solidification pattern of the cast bar by changing the direction of heat transfer and therefore the location of the grain boundary lines and also due to the shaped corners, the stresses set up in the cast bar as it solidifies. FIG. 4 illustrates a preferred embodiment of the present invention wherein a round, triangular or other suitably shaped material 48 is introduced into the mold corner near the junction of the band 31 and the wheel 32 to modify the shape of the resulting cast bar. It is advantageous to feed a rod of material which has a lower melting point than the metal to be cast into the mold so that during pouring of the molten metal the rod is partially melted as shown in FIG. 4*b* and is forced into the junction of the mold and band by the hydrostatic pressure of the molten metal so that at solidification the introduced sealing material will form a triangular shaped seal in the corner of the mold as illustrated in FIG. 4*c*.

Careful selection of the seal material permits various combinations of advantages. For example, if ablative, non-metallic material is selected the composition thereof can be such as to modify the chemistry of the solidifying metal in the corner regions so as to remove impurities or at least toughen the cast bar at those points. Such a material may be removed after casting or might be selected so as to disintegrate during the casting process. Or, for another example, a metallic material may be selected which bonds to the bar and forms a part thereof and may or may not be removed after casting as desired. The corner seal material may also be of a hollow metallic or non-metallic tube form which compresses into the mold corners due to hydrostatic pressure of the molten metal. In another example, a flat, type shaped strip of material may be applied between the casting band and the casting wheel to accomplish a change in the heat transfer rate or modify the chemistry of that region. However, the use of such a flat tape or strip will not provide rounded corners as will other embodiments of the invention unless the strip of material melts upon contact with the molten metal being cast.

In all the embodiments it is desirable that the corner shaping means is such that the resulting cast bar has a round shaped edge where the radius of curvature of the rounded edge is at least about ten percent of the shorter side of the cast bar. For example, if the mold is two inches deep and three inches wide, then the edges should have a radius of curvature of at least about 0.20 inches so that the solidification stresses will not cause corner cracking.

It will be understood by those skilled in the art that any variations may be made in the embodiment chosen herein for the purposes of illustrating the present invention without departing from the scope thereof as defined by the appended claims.

What is claimed is:

1. An improved process for the prevention of corner cracking during the continuous casting of metals of the type wherein molten metal is cast into a mold, formed by a peripheral groove in a rotating casting wheel and a band which seals a length of said groove, and wherein the molten metal is solidified in the shape of said mold to form a solid continuous length of cast bar which is subsequently extracted for further processing, wherein the improvement comprises introducing into said mold additional mold defining means for reducing the high heat transfer rates and for eliminating the sharp corners of the mold which both would otherwise occur at the junction of the wheel groove and the band, said means providing a thermal and physical barrier between the molten metal and said junction, reducing the solidification stress therein and forming a nonsharp edge on the solid length of cast bar with a radius of at least ten percent of the mold depth.

2. The process of claim 1 wherein said step for eliminating the sharp corners of the mold comprises introducing a solid sealing material into the mold near the junction of the mold and the band prior to casting the molten metal, then casting said molten metal into the mold containing said sealing material and cooling the molten metal to form a solid cast bar having a rounded edge, said rounded edge being generated by the presence of said sealing material.

3. The process of claim 1 wherein said step for eliminating the sharp corners of the mold comprises introducing an ablative material into the mold near the junction of the mold and the band prior to casting the molten metal.

4. The process of claim 1 wherein said step for eliminating the sharp corners of the mold comprises introducing said additional mold defining means attached to the casting band.

5. An improved process for the continuous casting of metals of the type wherein molten metal is cast into a mold formed by a peripheral groove in a rotating casting wheel and a band which seals a length of said groove, and wherein the molten metal is solidified in the shape of said mold to form a cast bar which is subsequently extracted from the mold for further processing, wherein the improvement comprises the step of introducing into said mold an additional mold defining means for eliminating the sharp corners of the mold which would otherwise occur at the junction of the wheel groove and the band; and wherein said step for eliminating the sharp corners of the mold further comprises introducing said additional mold defining means attached to the casting wheel and providing a barrier between the molten metal and said wheel and band junction and forming a nonsharp edge on the solid cast bar with a radius of at least ten percent of the mold depth.

6. An improved process for the continuous casting of metal of the type wherein molten metal is cast into a continuously advancing molding cavity formed by at least one endless moving band in conjunction with other mold surfaces so as to form a molding cavity having at least one sharp corner at the junction of said band and said other mold surfaces, and wherein the molten metal is solidified in the shape of said molding cavity to form a cast bar which is then extracted for further processing, wherein the improvement comprises the step of introducing into said cavity additional mold defining means for eliminating the sharp corner of the molding cavity, and thereby producing a cast bar having rounded edges, and wherein said step for eliminating the sharp corner of the mold cavity comprises introducing a formable material into the mold cavity near the junction of the said other mold surfaces and the band prior to casting the molten metal, said material being formed by hydrostatic pressure of the molten metal into a triangularly shaped additional mold defining means at the junction of the other mold surfaces and band.

7. The process of claim 6 wherein said formable material moves into and shapes the corner of the mold cavity and generates on the resulting cast bar a rounded edge having a radius of curvature of at least about ten percent of the shorter side of said cast bar.

8. The process of claim 6 wherein said formable material is selected from the group consisting of asbestos, paper, paper mache, glass fibers and mixtures thereof, when said molten metal is selected from the group consisting of aluminum, copper, steel and alloys thereof.

9. The process of claim 6 wherein said formable material is introduced into the mold cavity in the form of a hollow tube which is compressed into the mold corner by the hydrostatic pressure of the molten metal.

10. The process of claim 7 wherein said molten metal comprises steel and said resulting cast bar is substantially free from corner cracking.

11. The process of claim 5 wherein said molten metal is steel and said additional mold defining means which is attached to the casting wheel further decreases the heat transfer rates in the portion of the cast bar near said junction thereby reducing the solidification stress therein which cooperates with the nonsharp edge to substantially eliminate corner cracking of the cast steel bar.

12. An improved process for the continuous casting of metals of the type wherein molten metal is cast into a continuously advancing molding cavity formed by at least one endless moving band in cooperation with a peripheral groove in a rotating casting wheel, and wherein the molten metal is at least partially solidified in the shape of said molding cavity to form a continuous length of cast bar which is subsequently extracted from the molding cavity for further processing, wherein the improvement comprises the step of modifying the cross-sectional shape of said molding cavity by joining said band and said wheel with an additional mold defining means for eliminating the sharp corners of the molding cavity which would otherwise occur at the junction of said band and said wheel; and wherein said step further comprises attaching the additional mold defining means to the casting wheel prior to casting the molten metal therein to provide a barrier between the molten metal and said wheel and band junction and forming a nonsharp edge on the solidified cast bar.

* * * * *